US006133665A

United States Patent [19]

Prell et al.

[11] Patent Number: 6,133,665

[45] Date of Patent: Oct. 17, 2000

[54] BRUSH SYSTEM FOR ELECTRIC MOTORS

[75] Inventors: Edward T. Prell, Chicago; Ali I. Uzumcu, Vernon Hills; Edward G. Ennis, Niles, all of Ill.

[73] Assignee: S-B Power Tool Company, Chicago, Ill.

[21] Appl. No.: 09/134,101

[22] Filed: Aug. 14, 1998

[51] Int. Cl.[7] ..... H01R 39/38

[52] U.S. Cl. ..... 310/239; 310/245

[58] Field of Search ..... 310/239, 242, 310/245, 246, 40 MM, 247

[56] References Cited

U.S. PATENT DOCUMENTS

| | | | |
|---|---|---|---|
| 1,375,658 | 4/1921 | Gilchrist | 310/239 |
| 3,177,388 | 4/1965 | Cook | 310/247 |
| 3,423,618 | 1/1969 | Schmid et al. | 310/246 |
| 3,579,007 | 5/1971 | Walter | 310/242 |
| 3,617,786 | 11/1971 | Stielper | 310/242 |
| 4,110,651 | 8/1978 | Fagan | 310/239 |
| 4,338,538 | 7/1982 | Major | 310/242 |
| 4,355,254 | 10/1982 | Oki et al. | 310/242 |
| 4,381,468 | 4/1983 | Adam et al. | 310/239 |
| 4,471,254 | 9/1984 | Yamada et al. | 310/242 |
| 4,559,465 | 12/1985 | Gagneux | 310/242 |
| 4,571,515 | 2/1986 | Baader | 310/42 |
| 4,600,850 | 7/1986 | Mazzorana | 310/242 |
| 4,698,534 | 10/1987 | Smith et al. | 310/89 |
| 4,851,730 | 7/1989 | Fushiya et al. | 310/249 |
| 4,855,631 | 8/1989 | Sato | 310/239 |
| 4,873,464 | 10/1989 | Wang | 310/249 |
| 4,963,779 | 10/1990 | Lentino et al. | 310/71 |
| 5,043,619 | 8/1991 | Kartman, Jr. | 310/242 |
| 5,184,041 | 2/1993 | Baer et al. | 310/239 |
| 5,227,685 | 7/1993 | Krouse | 310/71 |
| 5,245,241 | 9/1993 | Gotoh | 310/239 |
| 5,248,910 | 9/1993 | Yockey et al. | 310/68 K |
| 5,532,536 | 7/1996 | Gaspar | 310/239 |
| 5,631,513 | 5/1997 | Coles et al. | 310/239 |
| 5,717,272 | 2/1998 | Gobled | 310/242 |

FOREIGN PATENT DOCUMENTS

| | | |
|---|---|---|
| 0043460 | 2/1982 | European Pat. Off. . |
| 0261542 | 3/1988 | European Pat. Off. . |
| 0291823 | 11/1988 | European Pat. Off. . |
| 0351293 | 1/1990 | European Pat. Off. . |
| 963506 | 7/1950 | France . |
| 3236091 | 3/1984 | Germany . |
| 3531309 | 5/1987 | Germany . |
| 3817735 | 12/1988 | Germany . |
| 1518921 | 7/1978 | United Kingdom . |
| 93/05561 | 3/1993 | WIPO . |

*Primary Examiner*—Nicholas Ponomarenko
*Assistant Examiner*—Joseph Waks
*Attorney, Agent, or Firm*—Greer, Burns & Crain, Ltd.

[57] ABSTRACT

A brush system for an electric motor is adapted to electrically connect a commutator with at least one field terminal of the motor. The system is provided in a housing of the motor and is accessible via an opening in the housing. In this system, at least one electrically conductive brush is held in contact with the commutator by an electrically conductive brush box, which has an electrically conductive connecting tab depending therefrom. The connecting tab is adapted to be connected to the field terminal. Also included is a frame which is configured and adapted to fixedly receive the brush box. A through hole is provided on the frame for allowing the connector tab to extend through the frame and connect to the field terminal. Further, an access door is configured and adapted to be latched to the opening in the housing by a latch device attached to the access door. A spring mechanism is also attached to the access door for exerting a force on the brush so that the brush maintains contact with the commutator when the access door is latched to the opening.

12 Claims, 3 Drawing Sheets

BRUSH SYSTEM FOR ELECTRIC MOTORS

The present invention generally relates to a brush system for electric motors, and more particularly to a brush holder assembly which connects brushes to motor field terminals without shunt wires, and to an access door of a motor housing which functions as a part of the brush holder assembly.

Generally, rotating electric motors that require commutation to operate have a brush assembly which holds electrically conductive brushes in contact with a commutator. The brushes are also electrically connected to field terminals which supply the power for energizing the proper coils on the rotor, via the commutator, to turn the rotor. As the rotor turns, the brushes wear against the commutator, and consequently, the worn brushes have to be replaced periodically. Typically, access doors are provided on the housing of the motor for allowing the brushes to be replaced. Some conventional methods for providing the access door on the housing, however, require a fastening operation during the manufacture of the tool in which the motor is implemented, such as providing screw holes for access doors which are screwed onto the housing, for example, thereby making the manufacturing process more complicated and expensive. Known access doors which do not require a fastening operation during the manufacture of the tool have designs which permit the doors to easily disengage from the housing with repeated use. The tools which have these types of designs are unsafe to operate, because in most cases, they also do not have a feature for stopping the motor when the access door is open.

Brush assemblies also require means for maintaining the brushes in constant contact with the commutator ring. Usually, this is accomplished by a spring mechanism which is incorporated in the brush assembly and located within the motor housing. Such an implementation, however, becomes impracticable when the space within the housing is limited.

Also, many known brush assemblies require shunt wires to be attached to the brushes so that the brushes can be electrically connected to the field terminals. Thus, each time the brushes are replaced, the shunt wires have to be attached to the brushes, which can be inconvenient and cumbersome.

Accordingly, it is a primary objective of the present invention to provide an improved brush system for electric motors.

Another object of the present invention is to provide such an improved system having a brush holder assembly which does not require shunt wires for electrically connecting the brushes to the field terminals.

Yet another object of the present invention is to provide such an improved brush system including an access door which does not require a fastening operation during the manufacture of the tool in which the electric motor is implemented.

A further object of the present invention is to provide such an improved system having an access door which securely engages the opening in the housing and does not unintentionally disengage from the housing.

Still another object of the present invention is to provide such an improved brush system which disables the tool when the access door is disengaged from the housing.

Another object of the present invention is to provide such an improved system having a spring mechanism for keeping the brush in contact with a commutator, occupying minimal space within the motor housing.

Other objects and advantages will become apparent upon reading the following detailed description, in conjunction with the attached drawings, in which.

DETAILED DESCRIPTION

The present invention is directed to a brush system of rotating electric motors including a brush holder assembly for keeping electrically conductive brushes in contact with a commutator. The brush holders or boxes of the brush holder assembly are electrically conductive and configured to be in contact with the brushes. The brush holder assembly has a connecting tab which is adapted to be connected to the field terminals of the motor, thereby electrically connecting the commutator to the field terminals.

The brush system also includes an access door having a latch which allows the door to be securely attached to the housing of the motor and to be removed only with a tool such as a screw driver. The access door is also equipped with a spring mechanism, which when the door is attached to the housing, pushes the brushes against the commutator to maintain an electrical contact between the brushes and the commutator. The spring mechanism also acts as an alternative circuit path between the brushes and the brush boxes.

Broadly stated, the present invention is directed to a brush system for an electric motor. The system is adapted to electrically connect a commutator with at least one field terminal of the motor, and is provided in a housing of the motor and accessible via an opening in the housing. The present brush system includes at least one electrically conductive brush in contact with the commutator and at least one electrically conductive brush box having an electrically conductive connecting tab depending therefrom. The brush box is adapted to hold the brush in electrical contact within the brush box, and the connecting tab is adapted to be connected to the field terminal. Also included is a frame which is configured and adapted to fixedly receive the brush box, and has a through hole for allowing the connecting tab to extend through the frame and connect to the field terminal. Further, an access door is provided, which is configured and adapted to latch to the opening in the housing by a latch device which is attached to the access door. A spring mechanism is also attached to the access door for exerting a force on the brush, so that the brush maintains an electrical contact with the commutator when the access door is latched to the opening.

Figure 1:
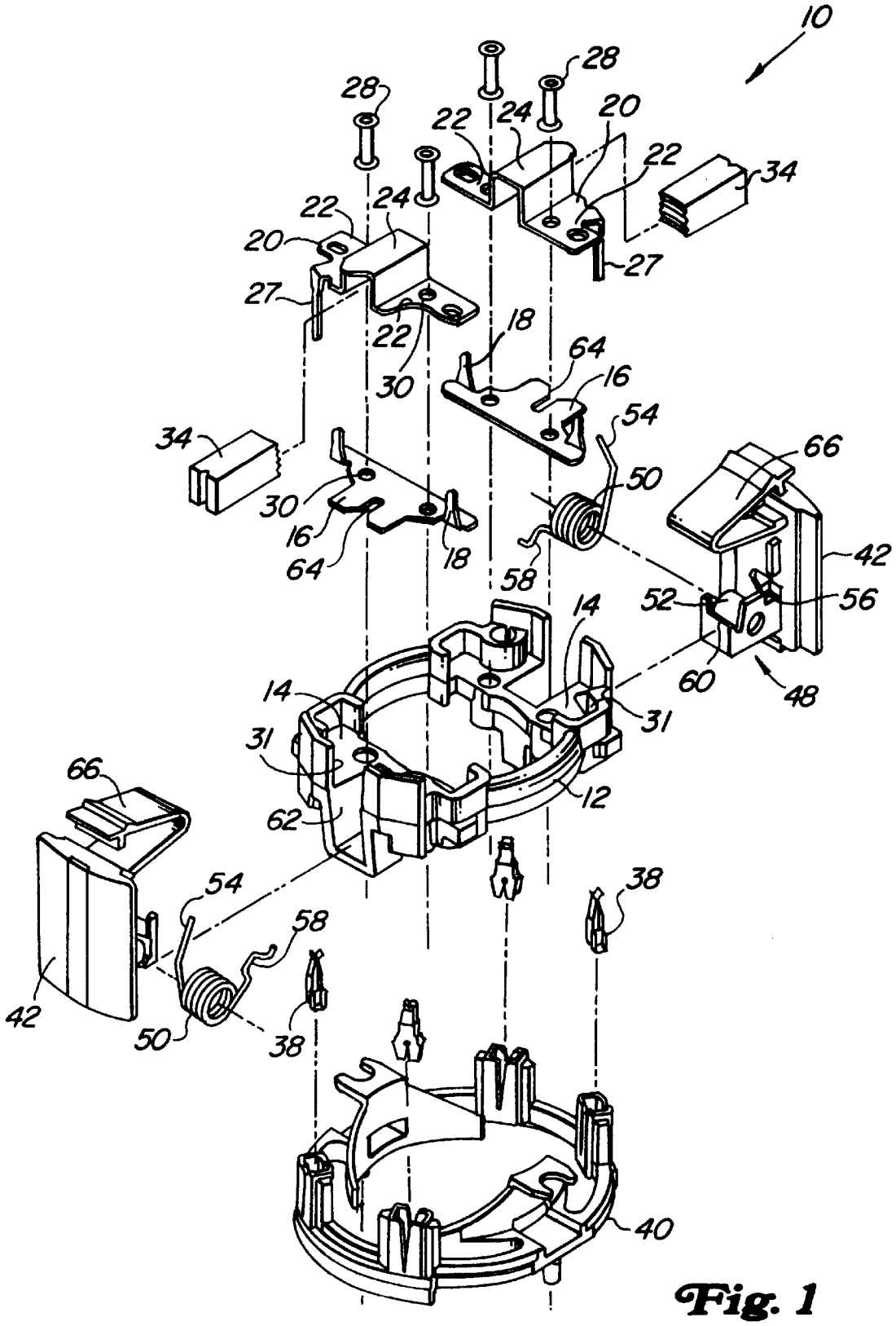
FIG. 1 is an exploded perspective elevational view of a brush system embodying the present invention.
Figure 2:
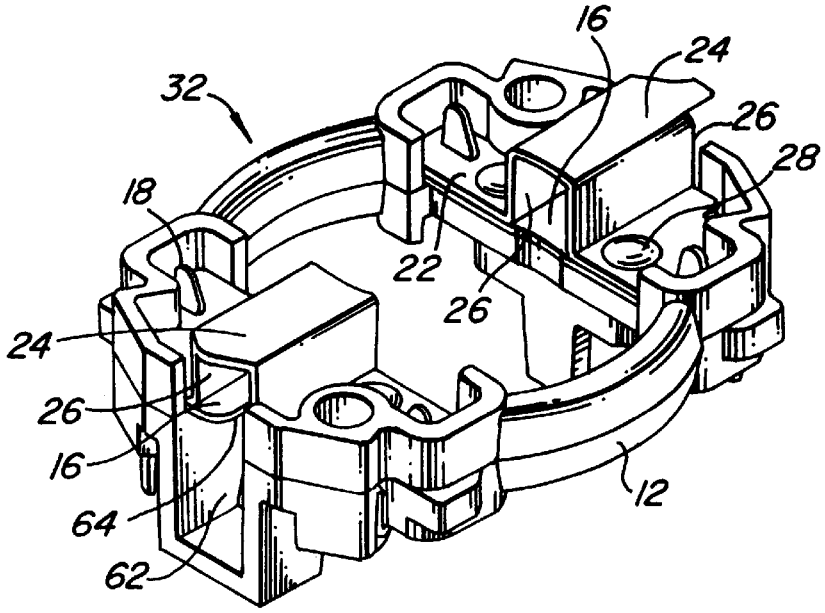
FIG. 2 is a perspective view of a brush holder assembly embodying the present invention.

Turning now to the drawings, and particularly FIGS. 1 and 2, a brush system, indicated generally at 10, includes a frame 12 which is substantially rigid and generally made of an electrically nonconductive plastic material. The frame 12 includes two seating areas 14, each of which is configured to receive a bottom plate 16. Two upwardly protruding alignment tabs 18 are provided on each bottom plate 16 to position a corresponding top plate 20 onto the bottom plate. Each of the two top plates 20 has two flat portions 22 which are separated by a generally rectangular tube 24, with the bottom side missing. A generally rectangular brush box 26 (best shown in FIG. 2) is formed when the tube 24 is put together with the bottom plate 16. The top plates 20 also have a connecting tab 27 which depends downwardly from one of the two flat portions 22.

It should be noted that while the preferred brush box 26 has a generally rectangular shape, it can have other shapes that conform to the shape of the brushes that are used. Also, the connecting tab 27 can depend from each of the bottom plates 16.

The top and the bottom plates 20, 16 are held together and fixedly seated in the seating areas 14 of the frame 12 by four eyelets 28 which are inserted through four holes 30 in each of the top and the bottom plates and the frame. The frame 12 also has two through holes 31 which allow each of the connecting tabs 27 to extend through and beyond the frame. Thus, the described components of the brush system 10 together form a brush holder assembly 32 (best shown in FIG. 2), which holds an electrically conductive brush 34 (best shown in FIG. 1) within each of the brush boxes 26 and in contact with a commutator 36 (best shown in FIG. 3).

In accordance with an important aspect of the present invention, the top and the bottom plates 20, 16 are made of an electrically conductive material such as copper or brass, and when the plates 20, 16 are assembled together with the frame 12, the extremely close toleranced box 26 is formed for the brush 34. As such, a direct electrical connection is established between the brushes 34 and the connection tabs 27, which are adapted to be connected directly to the field terminals 38 of a motor field terminal board 40 (best shown in FIG. 1). In this manner, the brushes 34 are electrically connected to the field terminals 38 without shunt wires which are required in conventional brush systems, thereby allowing the commutator 36 to be energized by the power supplied from the motor field terminal board 40.

Figure 3:
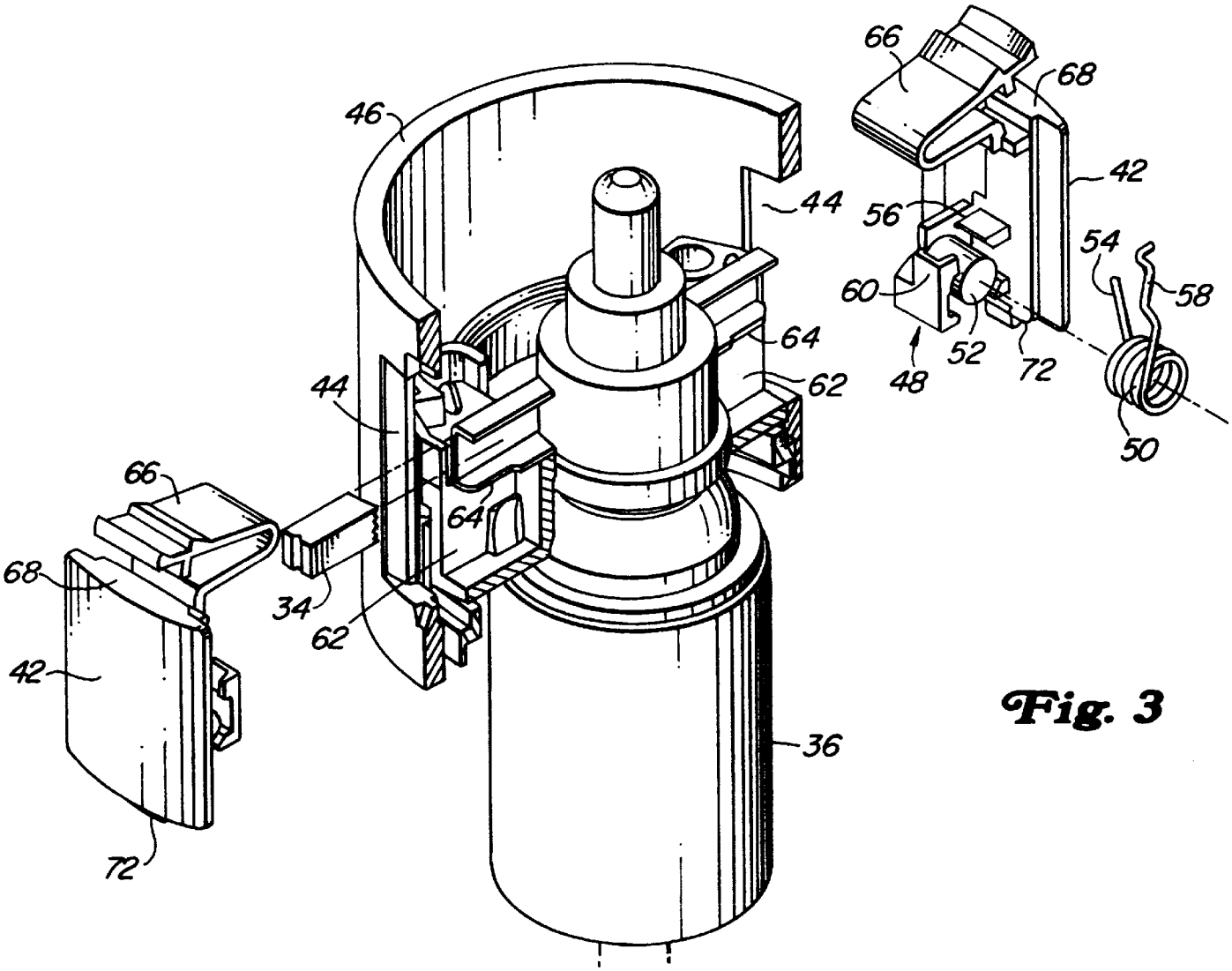
FIG. 3 is an assembled perspective view of the brush system of FIG. 1, with a portion of the brush holder assembly of FIG. 2 cut away, and including a commutator.

Turning now to FIG. 3, the brush system 10 of the present invention also includes a pair of access doors 42 which fits into openings 44 in the motor housing 46. The doors 42 allow access to the corresponding brush boxes 26 of the brush holder assembly 32, so that the brushes 34 can be replaced when worn.

In accordance with another important aspect of the present invention, the access doors 42 each have an integral spring mounting assembly 48 for a torsion spring 50. The spring mounting assembly 48 includes an anchor pin 52 over which the coiled portion of the spring 50 fits, so that when a first end of the spring 54 is positioned in a slot 56 and braced against the door 42, the second end 58 is pushed against a retaining bracket 60 under torsion. When the access door 42 is latched onto the opening 44, the spring mounting assembly 48 is received within a chamber 62 directly below the brush box 26 in the frame 12 (best shown in FIG. 2), and the second end 58 of the spring 50, which is bent into a generally S-shaped arm, fits into a slit 64 on the bottom plate 16 (best shown in FIG. 1) which forms the top of the chamber 62 (best shown in FIG. 2). The first end 54 of the spring 50 is pushed against the rectangular tube 24 (best shown in FIG. 4), thereby forming an alternative electrical path between the brush 34 and the brush box 26 via the spring 50.

Figure 4:
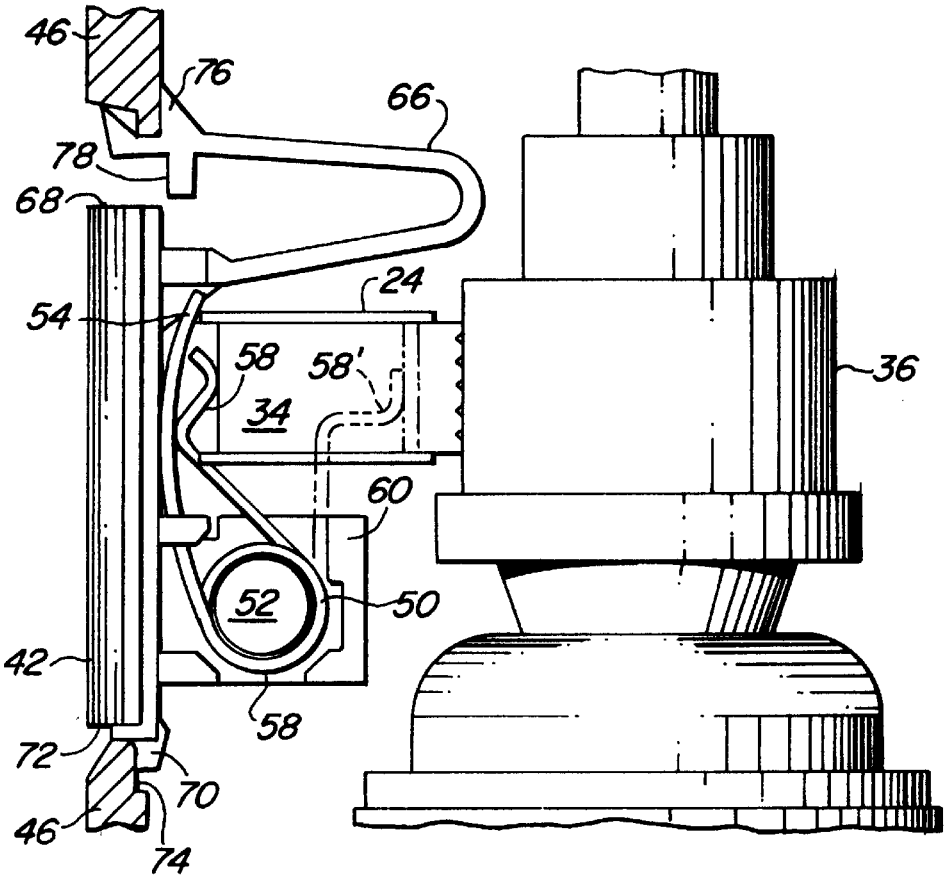
FIG. 4 is an enlarged side view of the access door of the brush system of FIG. 1 shown in relation to the commutator of FIG. 3, with parts removed for clarity, and also illustrating various positions of the spring in phantom.

It is important to note that while the spring mounting assembly 48 is provided on the access door 42, it is functionally a part of the brush holder assembly 32 when the door is latched to the housing 46. As shown in FIG. 4, when the door 42 is latched to the housing 46, the second end 58 of the spring 50 makes contact with the brush 34 through the slit 64 and exerts a force on the brush towards the commutator 36 until the brush wears to the point the second end rests against the retaining bracket 60 (the same second end 58 is shown in phantom at 58' in a rightward position to illustrate this operation). The spring 50 also acts as a safety device for disabling the electric motor in the event the door 50 is unlatched from the housing 46. In such an event, the brush 34 would lose electrical contract with the commutator and the alternative circuit path between the brush and the brush box 26 would be eliminated, resulting in an open-circuit condition and the disablement of the motor.

By providing the spring mounting assembly 48 on the access door 42, the structure of the brush holder assembly 32 is also significantly simplified, and the removal of the brushes is made significantly easier than the brush removal processes of some known brush assemblies, since the spring 50 does not act as an obstruction as in those known brush assemblies. Another advantage of the present invention is the vertical orientation of the spring assembly 48 relative to the brush box 26. This feature makes more efficient use of the space available in the housing 46, thereby allowing the brush holder assembly 32 to be more compact than some conventional brush holder assemblies.

Each of the access doors 42 includes a snap latch 66 which projects from near the top 68 of the door, and in conjunction with a lip 70 which projects integrally from the bottom 72 of the door (best shown in FIG. 4), is adapted to secure the door to the housing 46. The snap latch 66 is a looped cantilever spring having one end integrally attached near the top 68 of the door 42, and the other end generally over the top of the door, unattached, allowing the unattached second end to flex towards and away from the top of the door (best shown in FIG. 4 with the door 42 latched to the housing 46). The access door 42 is secured to the housing 46 by first hooking the lip 70 onto the inside wall 74 of the housing. Then the door is pushed so that the snap latch 66 is flexed downwardly by the force of the wall of the housing 46 at the opening 44 acting on an angled brace 76 (best shown in FIG. 4) until the brace clears the housing wall and flexes upwardly to catch the inside wall 74 of the housing.

One advantage of the snap latch 66 is that the access door 42 can only be removed by a sharp pointed tool, such as screw driver, and not by unaided fingers, coins or by an external blow. The removal is effectuated by inserting a pointed tool and pushing inwardly toward the commutator 36 at a foot 78 of the latch 66, thereby releasing the latch 66 from the opening 44 of the housing 46. Another advantage is that no additional fastener or fastening operation, such as providing a screw hole for the access door as in the type which is screwed onto the housing, is necessary during the assembly of the tool in which the electric motor is intended to be utilized.

It is should be noted that while the preferred embodiment of the present brush system has been described as having two brush boxes 26 and corresponding two access doors 42, the brush system 10 may have additional brush boxes and additional access door to correspond thereto.

From the foregoing description, it should be understood that an improved brush system has been shown and described which has many desirable attributes and advantages. The brush holder assembly includes an electrically conductive brush holders or boxes and connection tabs which are adapted to electrically connect the commutator to the field terminals, so that separate shunt wires are not required. Also, the spring assembly for keeping the brushes in contact with the commutator is provided on the access doors to make more efficient use of the space available in the housing and so that the spring assembly does not obstruct the removal of the brushes. The access doors also have an integral snap latch which allows the doors to be securely latched to the housing.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A brush holder assembly adapted to be provided within a housing of an electric motor for supporting at least one electrically conductive brush which is adapted to electrically connect a commutator to a field terminal, said assembly comprising:

at least one electrically conductive brush box having a connecting tab depending therefrom and adapted to hold the brush in electrical contact within said box, said connector tab being adapted to be connected to the field terminal;

a frame configured and adapted to fixedly receive said brush box, said frame having a through hole for allowing said connecting tab to extend through said frame and connect to the field terminal; and spring means provided on an access door of the housing for exerting a force on the brush in cooperation with said access door, so that the brush maintains an electrical contact with the commutator.

2. The assembly as defined in claim 1 wherein said brush box comprises an electrically conductive first plate and an electrically conductive second plate, said first and second plates being configured and adapted to electrically couple together.

3. The assembly as defined in claim 2 wherein said connecting tab depends from said first plate.

4. The assembly as defined in claim 2 wherein said connecting tab depends from said second plate.

5. The assembly as defined in claim 1 wherein said spring means includes a torsion spring.

6. The assembly as defined in claim 5 wherein said brush box includes a slit and said torsion spring exerts said force on the brush through said slit.

7. The assembly as defined in claim 1 wherein said frame includes a receiving chamber which is configured and adapted to receive said spring means when said access door is latched to the housing.

8. The assembly as defined in claim 7 wherein said receiving chamber is vertically oriented in relation to said brush box.

9. The assembly as defined in claim 1 wherein said spring means provides an electrical path between the brush and said brush box when said access door is latched to the housing, and eliminates said electrical path when said access door is unlatched from the housing.

10. The assembly as defined in claim 9 wherein said spring means includes a torsion spring having a first end and a second end, said first and said second ends being respectively electrically connected to said brush box and the brush when said access door is latched to the housing, and being respectively disconnected to said brush box and the brush when said access door is unlatched from the housing.

11. A brush system for an electric motor, said system being adapted to electrically connect a commutator with at least one field terminal of the motor, and being provided in a housing of the motor and accessible via an opening in the housing, said system comprising:

at least one electrically conductive brush in contact with the commutator;

at least one electrically conductive brush box having a connecting tab depending therefrom and adapted to hold said brush in electrical contact within said brush box, said connecting tab being configured and adapted to be connected to the field terminal;

a frame configured and adapted to fixedly receive said brush box, said frame having a through hole for allowing said connector tab to extend through said frame and connect to the field terminal;

an access door configured and adapted to latch to the opening in the housing;

latch means attached to said access door for latching said access door the opening; and spring means attached to said access door for exerting a force on said brush so that said brush maintains said contact with the commutator when said access door is latched to the opening.

12. The assembly as defined in claim 11 wherein said spring means provides an electrical path between said brush and said brush box when said access door is latched to the opening, and eliminates said electrical path when said access door is unlatched from the opening.

* * * * *